US006669027B1

(12) United States Patent
Mooney et al.

(10) Patent No.: US 6,669,027 B1
(45) Date of Patent: Dec. 30, 2003

(54) VIBRATORY SCREENING MACHINE AND VIBRATORY SCREEN AND SCREEN TENSIONING STRUCTURE

(75) Inventors: James A. Mooney, Tonawanda, NY (US); Keith F. Wojciechowski, Lakeview, NY (US)

(73) Assignee: Derrick Manufacturing Corporation, Buffalo, NY (US)

( * ) Notice: Subject to any disclaimer, the term of this patent is extended or adjusted under 35 U.S.C. 154(b) by 0 days.

(21) Appl. No.: 09/273,687

(22) Filed: Mar. 22, 1999

Related U.S. Application Data

(63) Continuation-in-part of application No. 09/272,498, filed on Mar. 19, 1999.

(51) Int. Cl.[7] ..... B07B 1/48

(52) U.S. Cl. ..... 209/405; 209/399; 209/403; 209/404; 209/408

(58) Field of Search ..... 209/404, 405, 209/408, 411, 392, 399, 403

(56) References Cited

U.S. PATENT DOCUMENTS

| | | | | |
|---|---|---|---|---|
| 1,438,489 A | | 12/1922 | Hawley | |
| 1,459,845 A | | 6/1923 | Mitchell | |
| 2,268,853 A | | 1/1942 | Behnke | 209/403 |
| 2,985,303 A | * | 5/1961 | Wright | 209/405 |
| 3,081,874 A | | 3/1963 | Corbin et al. | 209/408 |
| 3,406,823 A | | 10/1968 | Crain | 209/363 |
| 4,857,176 A | | 8/1989 | Derrick et al. | 209/392 |
| 4,882,054 A | | 11/1989 | Derrick et al. | 210/389 |
| 5,332,101 A | * | 7/1994 | Bakula | 209/403 |
| 5,417,859 A | | 5/1995 | Bakula | 210/388 |
| 6,000,556 A | * | 12/1999 | Bakula | 210/388 |
| 6,070,736 A | * | 6/2000 | Ballman et al. | 209/325 |
| 6,290,069 B1 | * | 9/2001 | Schwarze et al. | 209/405 |

* cited by examiner

*Primary Examiner*—Donald P. Walsh
*Assistant Examiner*—Daniel Schlak
(74) *Attorney, Agent, or Firm*—Joseph P. Gastel

(57) ABSTRACT

A vibratory screening machine having opposite sides with a plurality of stationary aligned tensioning members mounted on one side and a plurality of nut actuated movable tensioning members mounted on the opposite side and a vibratory screening screen mounted on the stationary and movable tensioning members. The tensioning members have upstanding fingers which are received in apertures in the plates of the vibratory screen, and the edge portions of the vibratory screen include screening material which extends all of the way to the extreme edges of the supporting plate and the fingers are below the screening material. Also, the tensioning structure is mounted on the side walls of the vibratory screening machine below the vibratory screen.

41 Claims, 9 Drawing Sheets

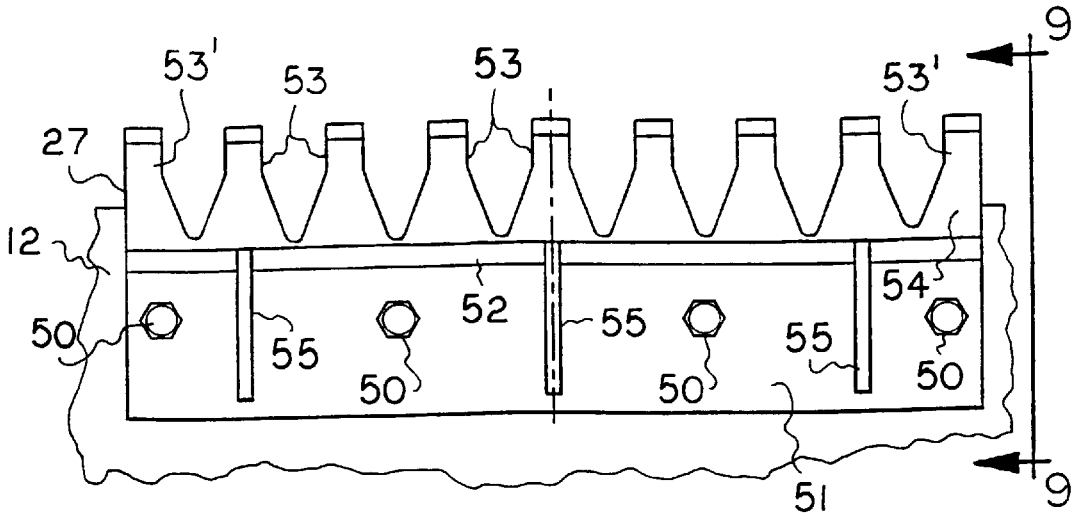
FIG. 8.
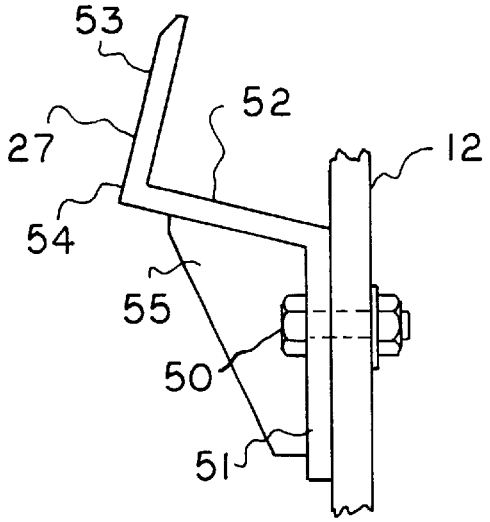
FIG. 9.
FIG. 10.
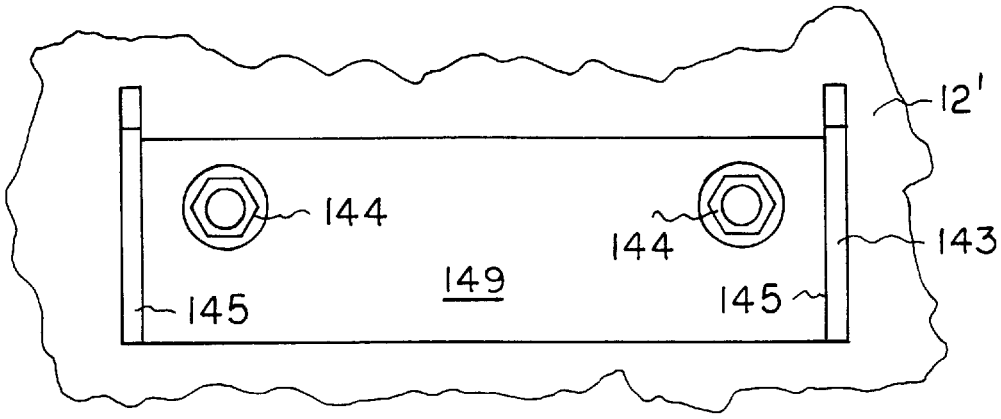

VIBRATORY SCREENING MACHINE AND VIBRATORY SCREEN AND SCREEN TENSIONING STRUCTURE

CROSS-REFERENCE TO RELATED APPLICATIONS

The present application is a continuation-in-part of application Ser. No. 09/272,498, filed Mar. 19, 1999.

STATEMENT REGARDING FEDERALLY SPONSORED RESEARCH OR DEVELOPMENT

Not Applicable

BACKGROUND OF THE INVENTION

The present invention relates to an improved vibratory screening machine and an improved vibratory screen and to an improved tensioning structure for a vibratory screening machine.

In the past, a conventional way of mounting vibratory screens on vibratory screening machines was by utilizing elongated channel members on the sides of the machines which interfitted with channels formed at the side edges of a screening screen. However, this system had certain deficiencies. One deficiency was that the channels formed on the side edges of the screen would distort. Another deficiency was that the tensioning channels had to be moved clear of the channels on the edges of the screens before the screens could be demounted from the machine. This was a time-consuming operation, considering that generally twelve bolts had to be loosened on each side of the machine before screens could be removed and thereafter all twenty-four bolts had to be tightened after new screens had been replaced. In addition, the use of the foregoing channel-type of tensioning structure was especially detrimental when used in conjunction with undulating screening screens because the material to be screened would accumulate in the areas of the channels and thus create turbulent flow of the material to be screened which caused excessive wear on the undulations adjacent the side edges of the screens. Additionally, the foregoing type of tensioning system utilizing channels required the bolts which moved the tensioning channels to pass through apertures in the sides of the machine above the screens. Thus, material to be screened could pass through these apertures and mix with the material which passed through the screens. In addition to the foregoing, since the channels on both sides of the machine had to be loosened in order to remove and replace the screens, both sides of the screening machine had to be placed so that access could be had thereto. In certain instances this required premium floor space, especially on offshore oil drilling rigs. It is with addressing the foregoing deficiencies of the prior art that the present invention is concerned.

BRIEF SUMMARY OF THE INVENTION

It is accordingly one object of the present invention to provide an improved tensioning system for a vibratory screening machine which permits rapid mounting and demounting of vibratory screening screens.

It is another object of the present invention to provide an improved tensioning system for a vibratory screening machine which requires access to only one side of the machine.

Yet another object of the present invention is to provide an improved mounting arrangement on a vibratory screen which does not require conventional channel-types of mounting structures.

A further object of the present invention is to provide an improved vibratory screening screen in which there is no excessive wear in the areas which are adjacent the side edges of the screening screen.

Yet another object of the present invention is to provide an improved vibratory screening machine wherein the tensioning structure which is mounted on the sides of the machine engages the screen from underneath, thereby obviating the requirement for holes in the sides of the machine above the screens through which material to be screened can flow. Other objects and attendant advantages of the present invention will readily be perceived hereafter.

The present invention relates to a vibratory screening machine comprising a frame, opposed first and second side walls on said frame, a fixed screen-engaging member on said first wall, and a movable screen-engaging member on said second wall.

The present invention also relates to a vibratory screen tensioning member comprising an elongated body, a base on said elongated body, and a plurality of spaced fingers on said base extending longitudinally of said body.

The present invention also relates to a vibratory screen comprising a plate, first and second side edges on said plate, first and second series of spaced apertures proximate said first and second side edges, respectively, first and second flanges on said plate located outwardly of said first and second series of apertures, respectively, a screen on said plate, and first and second side edges on said screen secured to said first and second flanges, respectively.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 8 is a side elevational view of the fixed tensioning member;

FIG. 9 is an end elevational view taken substantially in the direction of arrows 9—9 of FIG. 8.

FIG. 10 is a fragmentary side elevational view of the support for the movable tensioning member mounted on the side of the machine;

DETAILED DESCRIPTION OF THE INVENTION

Figure 1:
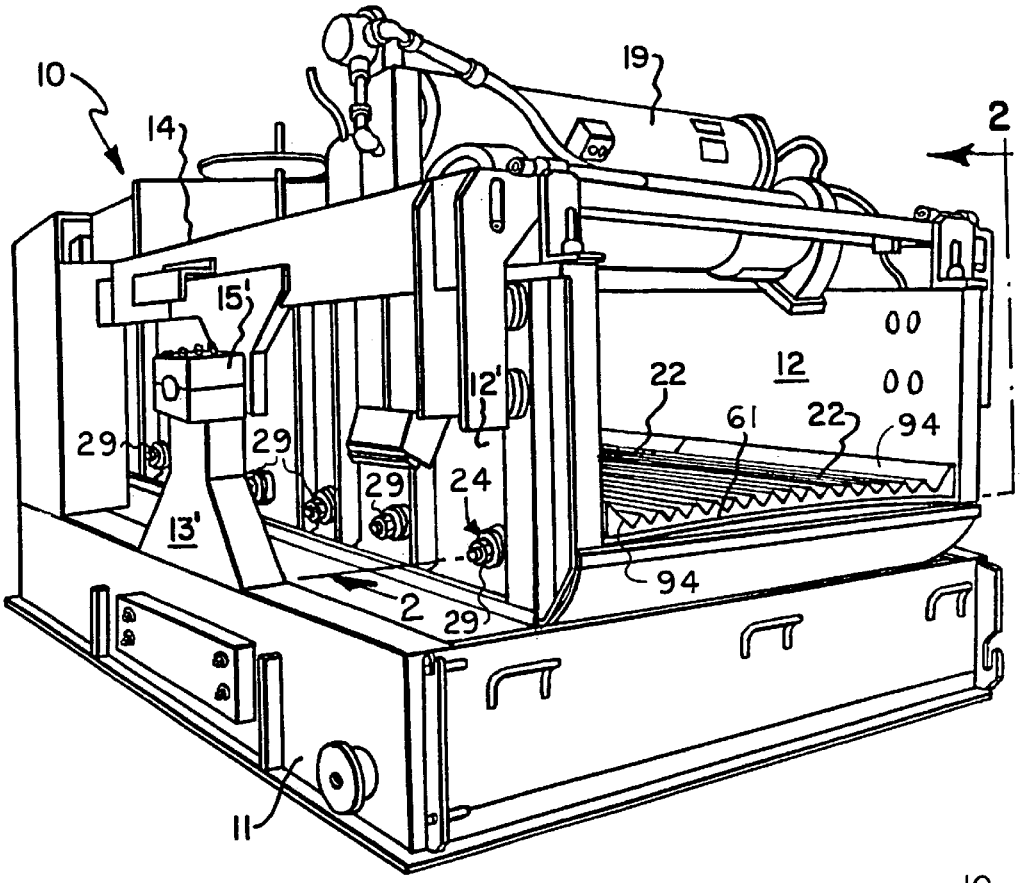
FIG. 1 is a perspective view of a vibratory screening machine mounting the improved screen and screen tensioning structure of the present invention.
Figure 2:
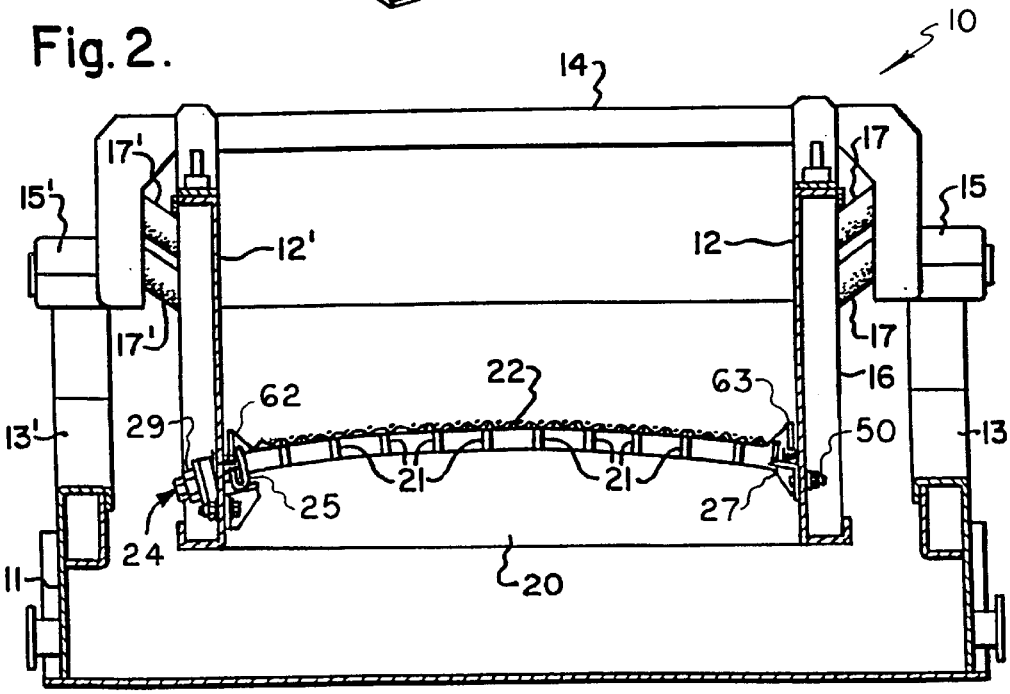
FIG. 2 is a cross sectional view taken substantially along line 2—2 of FIG. 1 and showing a vibratory screen of the present invention in position on the bed of the machine and tensioned by the tensioning structure of the present invention.
Figure 3:
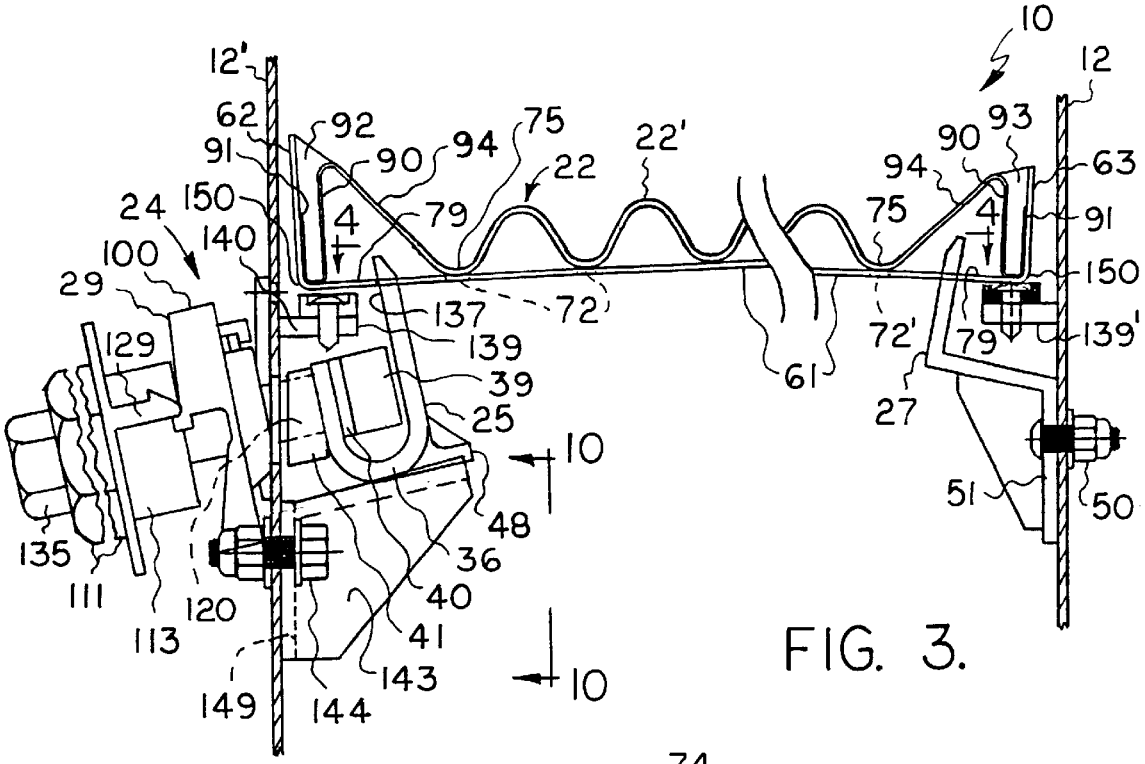
FIG. 3 is a fragmentary enlarged view of the portion of FIG. 2, with parts omitted, showing the improved screen and the associated tensioning structure.
Figure 19:
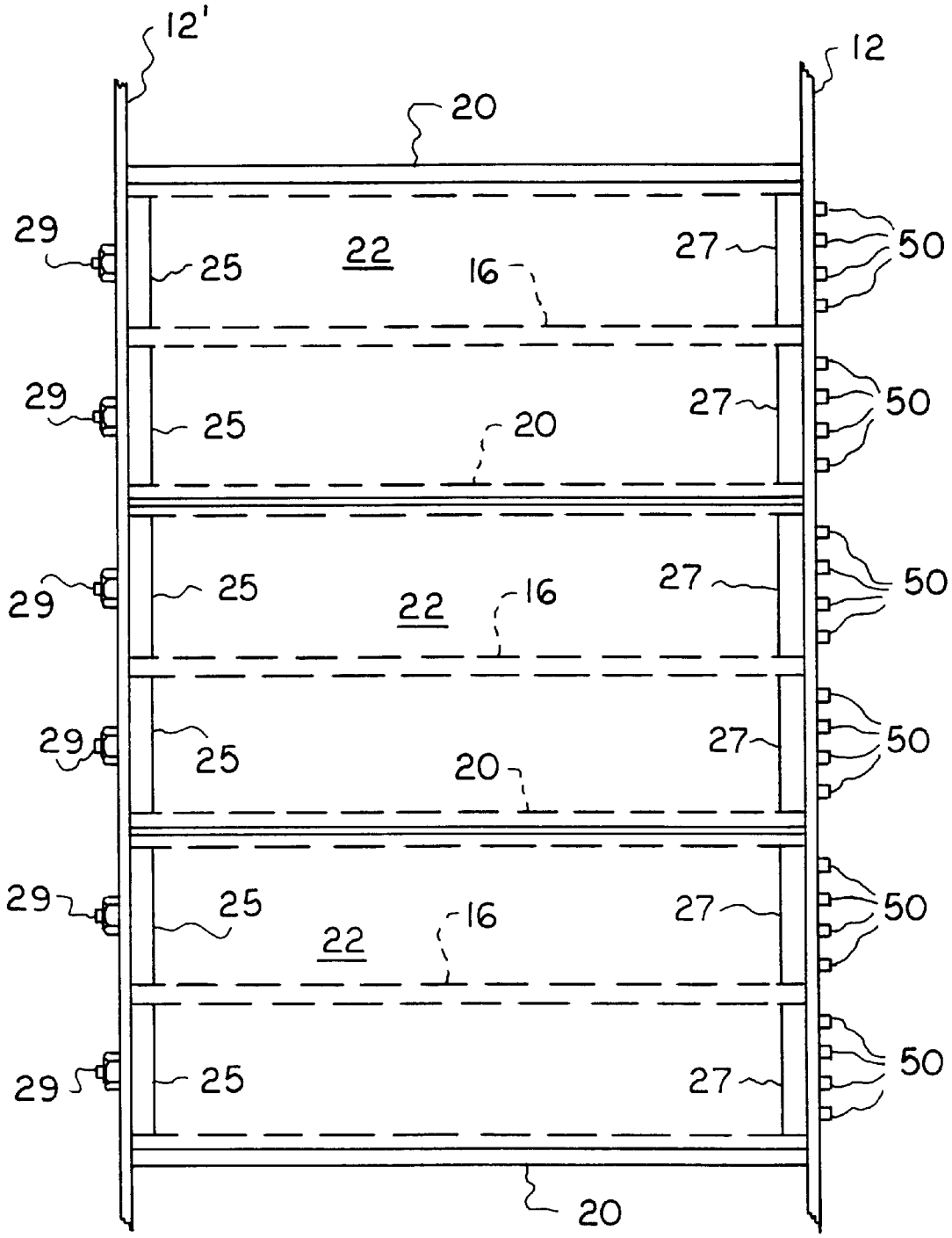
FIG. 19 is a schematic view of a plurality of screens mounted between the sides of the vibratory screening machine.
Figure 20:
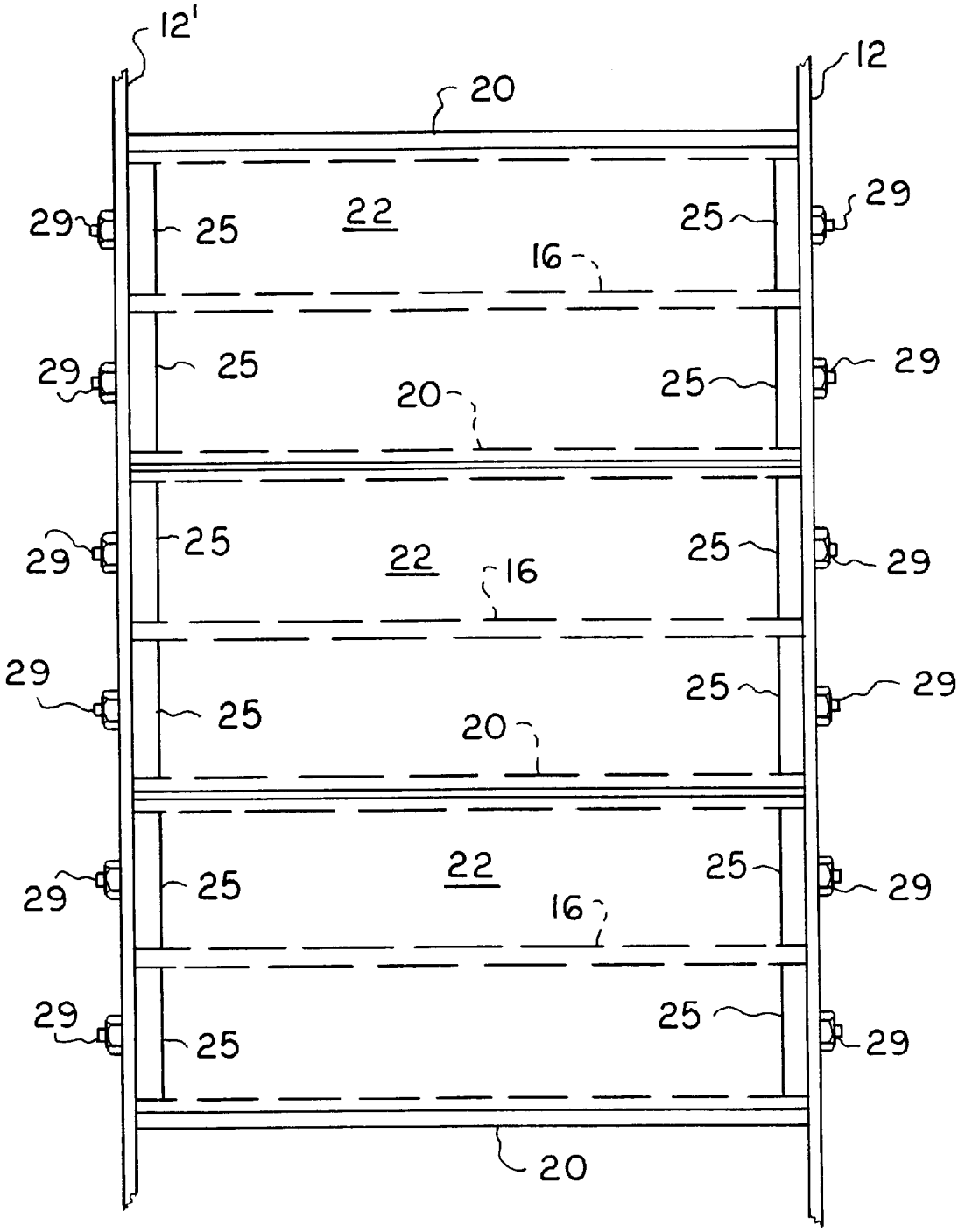
FIG. 20 is a schematic view of a plurality of screens mounted between the sides of the vibratory screening machine and having movable tensioning members on both sides of the machine.

The improved screen tensioning structure of the present invention is for mounting on a vibratory screening machine of any suitable type. Vibratory screening machine 10 of FIGS. 1–3 is of conventional construction except for certain structure, namely, the structure associated with the improved tensioning structure of the present invention. Thus, the vibratory screening machine 10 may be of the types shown in U.S. Pat. Nos. 5,332,101 and 4,882,054, the latter two patents being incorporated herein by reference and which should be referred to for a better understanding of the present invention. By way of specific description, the vibratory screening machine 10 includes a base 11 having a vibratory frame 14 suitably mounted thereon. Standards 13 and 13', which are mirror image counterparts, are mounted on base 11, and they pivotally support frame 14 by means of trunnions 15 and 15'. Side walls 12 and 12' are resiliently mounted on frame 14 by means of elastomeric connectors 17 and 17' to permit the screen-supporting assembly 16 to vibrate when actuated by vibrator motor assembly 19 suitably connected thereto. The foregoing type of mounting is conventional in the art. In addition to struts 16 which connect walls 12 and 12' to each other, a plurality of cross members 20 (FIGS. 2, 19 and 20) are spacedly mounted between side walls 12 and 12' and suitably connected thereto, and elongated stringers 21 extend longitudinally of the machine and are connected to struts 16 and cross members 20. The stringers and cross members comprise the bed of the machine, as is well known in the art. In operation, the vibratory screen assembly 22 rests on the bed of the machine which includes struts 16 and cross members 20, and plastic caps (not shown) are mounted on stringers 21, as is well known in the art, as more specifically shown in U.S. Pat. No. 4,857,176, which, insofar as pertinent here, is incorporated by reference and for showing a better understanding of the present invention. As noted above, vibratory screening machine 10, as expressed above, is substantially identically described in U.S. Pat. No. 5,332,101. Furthermore, as expressed above, any suitable vibratory screening machine, with suitable modification, can mount the improved screen tensioning structure of the present invention.

The screen tensioning structure 24 of the present invention broadly includes a movable tensioning member 25 mounted on machine wall 12', a stationary tensioning member 27 mounted on wall 12 and a tightening nut assembly 29.

Figure 7:
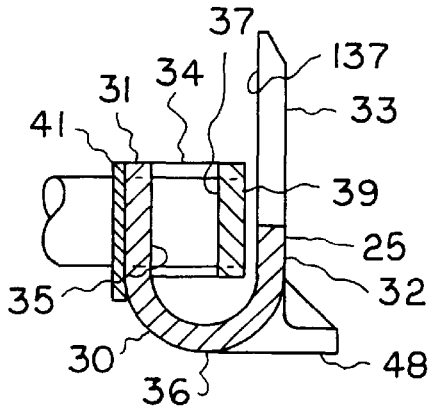
FIG. 7 is an enlarged cross sectional view taken substantially along line 7—7 of FIG. 5.

The movable tensioning member 25 includes an elongated body 30 which is of generally U-shaped configuration (FIG. 7) having a rear side 31 and a front side 32 connected by base or U-bend 36. A plurality of spaced flexible resilient fingers 33 extend from side 32. U-bend 36 is also flexible and resilient. A block 34 has one side welded to rear side 31 at 35 and the opposite side of block 34 is welded at 37 to the central portion of reinforcing bar 39 which has its opposite ends welded to rear side 31 at 40. The portion of reinforcing bar on block 34 is spaced from front side 32. Reinforcing bar 39 rigidizes rear side 31 against excessive flexing. A band spring 41 is riveted to rear side 31 by a plurality of rivets 42. Fingers 33 have relatively narrow upper portions 43 which merge into downwardly outwardly flaring portions 44 which merge into front side 32. The outermost fingers 45 have upper portions 43' which have the same width as upper portions 43 of fingers 33. However, the lower portions 44' of fingers 45 are narrower than the lower portions 44 of fingers 33. Therefore, the lower portions 44' terminate at valleys 47 which are higher than valleys 49 which are positioned between fingers 33. This is so that fingers 45 will flex substantially the same amounts as fingers 33 when they are stressed during the tensioning process. A plurality of inverted T-shaped members 48 extend outwardly from the bottom of front side 32 for slidingly engaging the tops of spaced sides 145 of support 143 (FIGS. 3 and 10).

The elongated planar base 51 of fixed tensioning member 27 (FIGS. 8 and 9) is rigidly mounted on wall 12 by a plurality of nut and bolt assemblies 50 which extend through base 51. A central portion 52 extends upwardly and outwardly from base 51, and a plurality of flexible resilient fingers 53 and 53', which are identical to fingers 33 and 45, respectively, extend upwardly from side 54 which extends upwardly from central portion 52. A plurality of gussets 55 extend between base 51 and central portion 52 to rigidize the latter against bending. As can be seen from FIG. 3, there are no tensioning nut assemblies on side 12 of the machine. Therefore, this side of the machine need not be accessed for changing the screen assemblies 22. Thus, side 12 can be placed closely adjacent a wall or other objects, thereby conserving space, which is especially desirable on offshore drilling rigs where space is a premium. The resilience of the fingers on both the movable tensioner 25 and stationary tensioner 27 tend to maintain a substantially constant tension on the screening screen 22.

Figure 11:
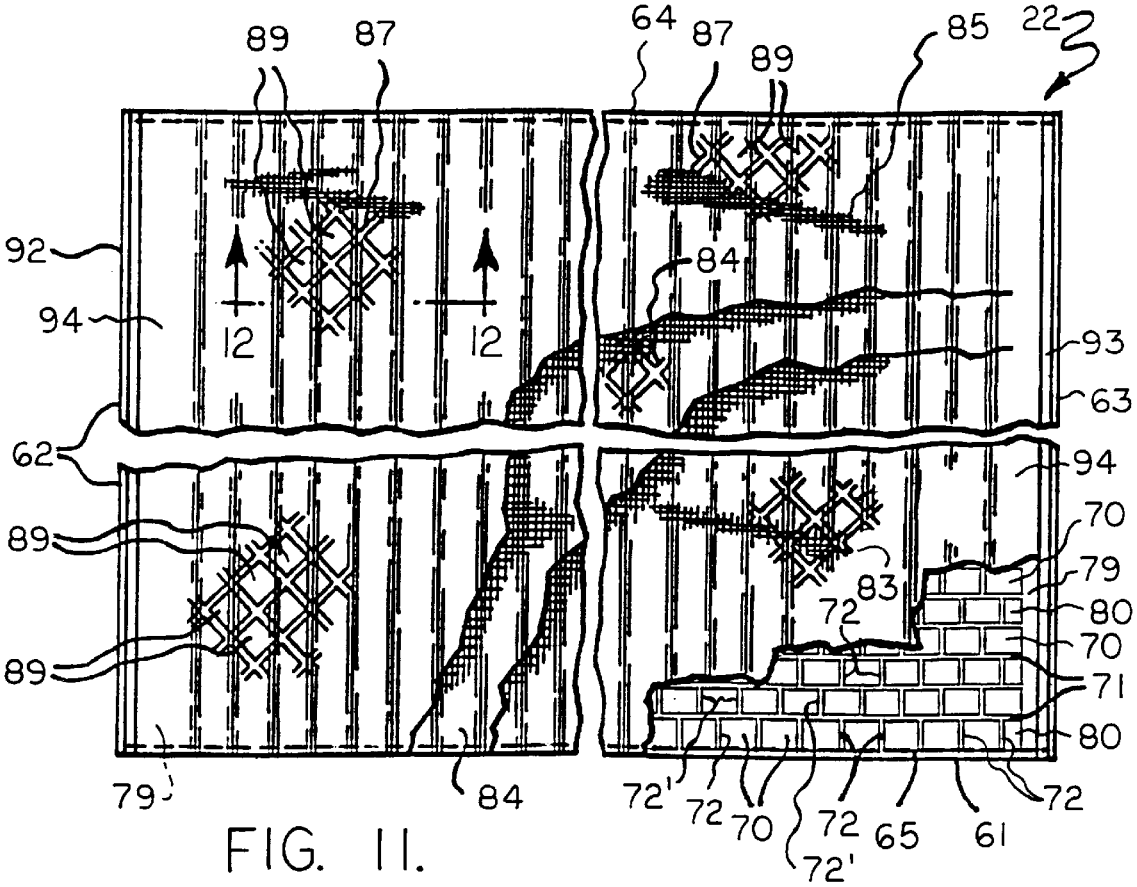
FIG. 11 is a fragmentary plan view of the improved screen of the present invention.
Figure 12:
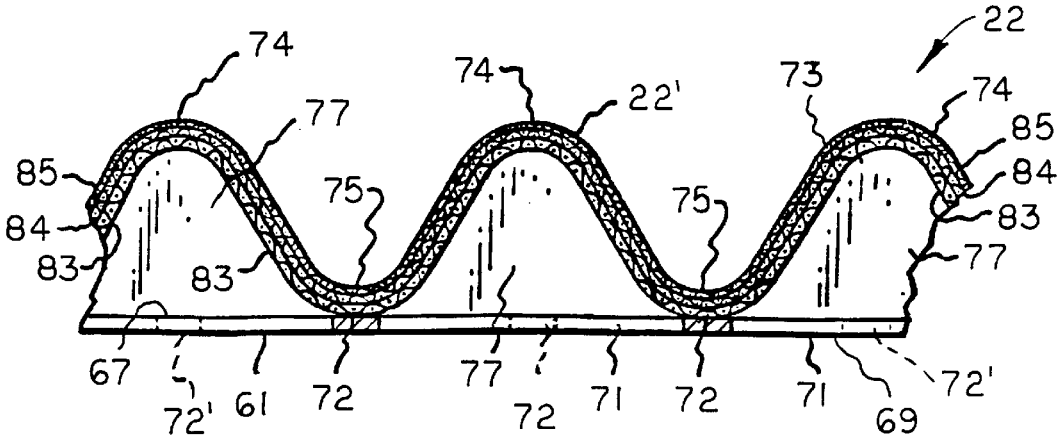
FIG. 12 is a fragmentary enlarged cross sectional view taken substantially along line 12—12 of FIG. 11.

The improved tensioning structure 24 is preferably used with a screen assembly such as 22 of FIGS. 11 and 12, which is a modified form of the screen disclosed in U.S. Pat. No. 5,417,859 which is incorporated herein by reference and which can be referred to for better understanding of the screen assembly structure. The screen assembly includes a frame in the form of a perforated metal plate 61, such as steel or any other suitable material, having a first pair of opposite side edges 62 and 63 and a second pair of opposite edges 64 and 65 and an upper surface 67 and a lower surface 69. Plate 61 includes apertures 70 which are bordered by elongated metal strip-like portions or members 71 which extend between side edges 62 and 63 and by shorter strip-like portions 72 and 72' which extend lengthwise between elongated strip-like portions 71. The apertures 70 in the rows adjacent to edges 64 and 65 are 1.71 by 1½ inches and are formed by a punching operation and have rounded corners. The apertures 70 between the rows adjacent to edges 64 and 65 are quadrangles of 1.687 by 1 3/16 inches. Strip-like portions 71 are 0.1875 inches wide and strips 72 and 72' are approximately 0.1217 inches wide, but the various strips may be of any desired width and the apertures 70 may be of any desired dimensions. The length of plate 61 between edges 12 and 13 may be approximately 3½ feet, and its width between edges 64 and 65 may be approximately 2½ feet and it may have a thickness of 14 gauge, or any other suitable thickness. It will be appreciated that the size of plate 11 may vary as required to fit different machines. Edges 62 and 63 are mirror-image counterparts. The outer edges 62 and 63 are formed into longitudinally extending flanges which extend throughout the entire width of plate 61, that is, they extend all the way between edges 64 and 65.

Figure 4:
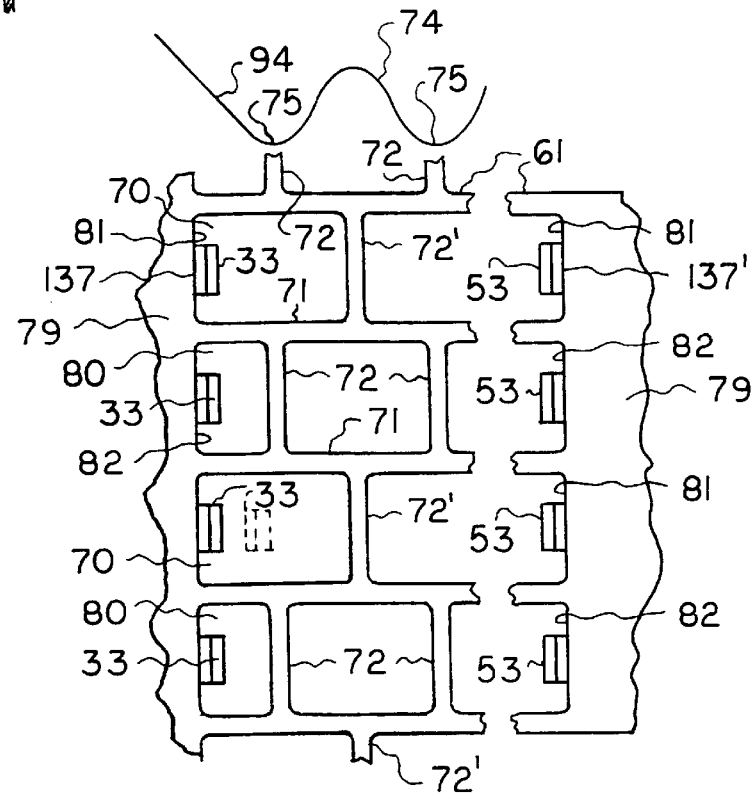
FIG. 4 is an enlarged fragmentary view taken substantially in the direction of arrows 4—4 of FIG. 3 with the major portion of the screen omitted and showing in solid lines the fingers of the screen tensioner structure bearing against the sides of the apertures at the borders of the screen plate and also showing schematically in dotted lines the positions of the fingers on one side of the machine when the plate is being mounted and demounted.
Figure 5:
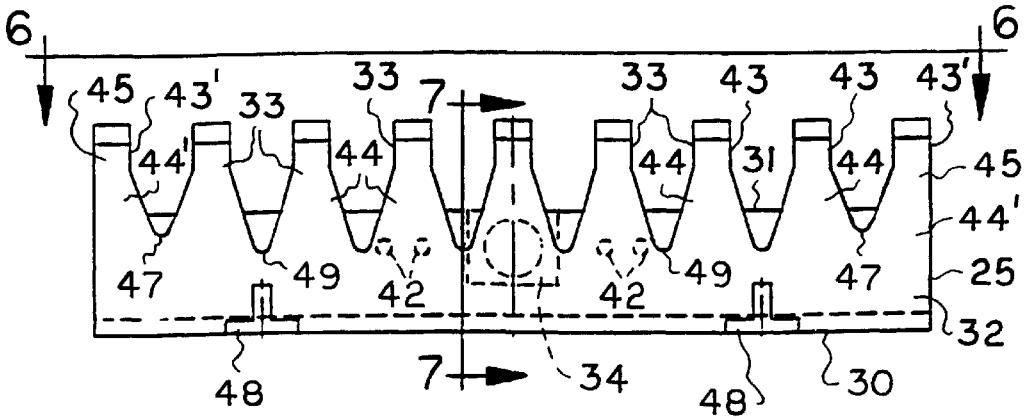
FIG. 5 is a side elevational view of the movable tensioning member.

A screen subassembly 73, which is fully disclosed in the above-mentioned U.S. Pat. No. 5,417,859, is of undulating shape and has ridges 74 alternating with grooves 75. Epoxy end caps 77 seal both ends of ridges 74 at edges 64 and 65. As can be seen from FIG. 11, the undersides of troughs 75 are bonded to rows of aligned strip-like members 72 and the peaks of ridges 74 overlie rows of aligned strip-like members 72' which are interspersed with rows of strip-like members 72. See FIGS. 4 and 11. The outer edges 62 and 63, which are flanges (FIG. 3), as expressed above, are proximate horizontal side edge portions 79 (FIGS. 4 and 11). Immediately adjacent side edge portions 79, which lie in the plane of plate 61, are larger apertures 70 which alternate with smaller apertures 80 which have edges 81 and 82, respectively, which are substantially in alignment.

The undulating screen subassembly 22', which is part of screen assembly 22, in this instance consists of a heavy screen 83, a fine screening screen 84 and a finer screening screen 85, all of which are bonded by a fused plastic grid 87 having openings 89 therein. The screen subassembly 22' at its outer edges is formed into planar sides 90 which are parallel to flanges 62 and 63, and the extreme outer edges of screen subassembly 22' are turned up into short sides 91 which are parallel to sides 90. The space between screen side 90 and flange 62 is filled with epoxy 92 and the space between screen side 90 and flange 63 is filled with epoxy 93. Strips 92 and 93 of epoxy extend the entire distances between edges 64 and 65. The portion of the screen between sides 90 and 91 is preferably bonded to plate 61. The configuration at screen portions 90 and 91 is merely by way of example and not of limitation, and it will be appreciated that other configurations for securing the ends of screen subassembly 22' to plate 61 may be utilized.

As can be seen from FIGS. 3 and 4, the screen subassembly 22' has straight screen portions 94 between the troughs 75 closest to planar portions 79 and screen sides 90. However, screen portions 94 may be curved. The screen portions 94 provide additional screening area as compared to prior constructions wherein the screen subassembly did not have any screen portion such as 94 beyond the last trough, such as 75, which was closest to the outer edges of the plate. The screen portions 94 in addition to providing additional screening area also provide unrestricted flow paths for material to be screened. This is in contrast to prior art structures which utilized channel-type tensioners which became clogged and thus produced turbulent flow which abraded the sides of the ridges closest to the sides of the machine which resulted in screen failure.

The screen tensioning structure 24 includes a plurality of bolt assemblies 29 mounted on one side wall 12' (FIGS. 1–3). Actually there are two bolt assemblies 29 associated with each screen assembly 22, and there are three screen assemblies 22 mounted on the bed of the machine. Thus, there are six bolt assemblies 29 mounted on the machine side 12'. However, there are no bolt assemblies, such as 29, mounted on machine side 12 (FIG. 3) because the stationary tensioning members 27 are bolted to screen side 12. The advantage of the foregoing installation is that only the six bolt assemblies 29 on one side of the machine have to be loosened, as will appear hereafter, in order to demount the three screen assemblies 22 whereas in the past in installations utilizing channels at the side edges of the screen assemblies 22, twelve bolt assemblies were required on each side of the machine, for a total of twenty-four. Each bolt assembly had to be loosened in order to permit the channels of the prior art tensioning structure to be withdrawn from the channels at the side edges of each prior art screen assemblies. This required an exceptionally long time, and while the prior art screen assemblies were being changed, the flow of material which was to be screened was diverted. However, as will appear hereafter, the screen assemblies 22 can be changed by merely loosening the six bolt assemblies 29 on one side of the machine and thus the screen assemblies 22 can be changed in a matter of between 3 and 4 minutes whereas in the prior art requiring twenty-four bolt assemblies, the time required to change three screens usually was between about 10 and 15 minutes.

Figure 6:
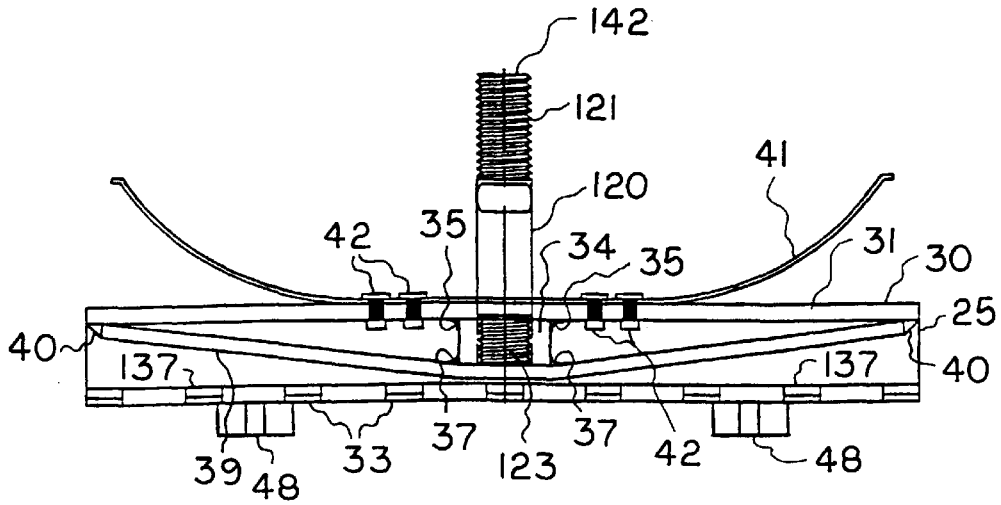
FIG. 6 is a plan view of the movable tensioner taken substantially in the direction of arrows 6—6 of FIG. 7.

Each tightening nut assembly 29 is extremely similar to that disclosed in U.S. Pat. No. 5,332,101, which is incorporated herein by reference and which should be referred to for background material. However, the tightening nut assembly 29 differs from that disclosed in the foregoing patent in that it does not utilize a spring. Instead it has a rigid cylindrical central member 117 which can be adjusted to determine the stroke of the nut assembly 29. More specifically, each tightening nut assembly 29 is mounted on the machine side 12' on a generally triangular solid member 102 which is welded to machine side 12' and has parallel planar sides 103 and a lip 104. The rear of fixed tightening member 100 includes two flanges 105 which straddle sides 103 in contiguous relationship and top member 107 has a portion 109 which rests on the top of lip 104 and it has a lip 110 which lies behind lip 104, to thereby firmly mount stationary nut tightening member 100 onto the side 12' of the machine. The movable tightening member 101 includes an outer nut 111 which is integral with flange 112 which is integral with cylindrical extension 113 which terminates at an end wall 114 at the end of cylindrical chamber 115. A cylindrical central member 117 is rotatably mounted within chamber 115 and is retained therein by means of snap ring 119. Bolt 120 has a threaded end 121 (FIG. 6) which is received within threaded portion 122 of cylindrical member 117. The opposite end of bolt 120 is threaded at 123 (FIG. 6) and is threadably received in block 34 of tensioning member 25. The central portion of bolt 120 passes through aperture 126 in wall 12' and through aperture 126' in triangular member 102 and aperture 128 in fixed tightening member 100 and through aperture 136 in wall 114 of movable tightening member 101. Fixed nut tightening member 100 includes two cam tracks 123 having lower portions 124 and higher portions 125. The higher portions terminate at lips 127 which are located immediately above the lowest portions of low portions 124. Diametrically opposite cam followers 129 extend radially outwardly from cylindrical portion 113 of movable member 111 and they terminate at cam follower edges 130 which ride on cam surfaces 123.

The screen tensioning system of the present invention is initially adjusted as follows. First of all, the tightening nut assemblies 29 are set with the cam followers 129 on the highest portions 125 of cams 123 which are adjacent lips 127. Thereafter, nut 135, which is integral with cylindrical member 117, is rotated while member 117 is in threaded engagement with bolt threads 121 until the inner sides 137 of fingers 33 are spaced approximately ⅜ inch from the edge of shelf 140 which extends longitudinally along side wall 12' throughout the extent of the side wall underneath three of the screen assemblies 22, each of which has two tension members 25 associated therewith in end-to-end relationship. Each of the six tensioners 25 is adjusted in the foregoing manner. Thereafter, the set screw 141 is adjusted until it hits the end 142 of bolt 120. The set screw has a thread locking compound thereon so that once it has been set, it cannot be unscrewed. In view of the foregoing adjustment, bolt 120 can never be threaded into threaded bore 122 a greater extent than to which it has been set, and thus the inner surfaces 137 of fingers 33 cannot be moved any closer to the edges 139 of shelf 140. However, member 117 can be unscrewed from bolt 120 to thus increase the distance between fingers 33 and edge 139.

The foregoing adjustment is made while each tensioner 25 is mounted on tensioner support 143 which is rigidly mounted on side wall 12' by bolts 144. Each support includes two sides 145 and a back plate 149 through which bolts 144 extend to secure support 143 to side wall 12'.

Figure 14:
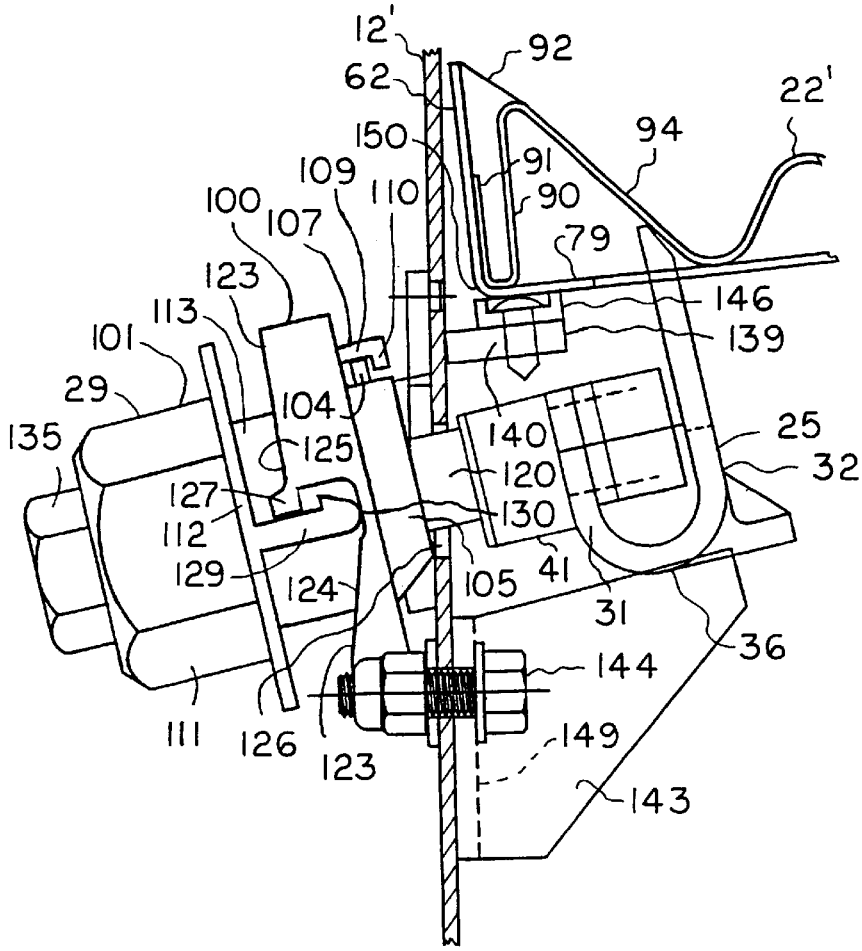
FIG. 14 is a side elevational view of the tightening nut assembly mounted on the wall of the vibratory screening machine.
Figure 15:
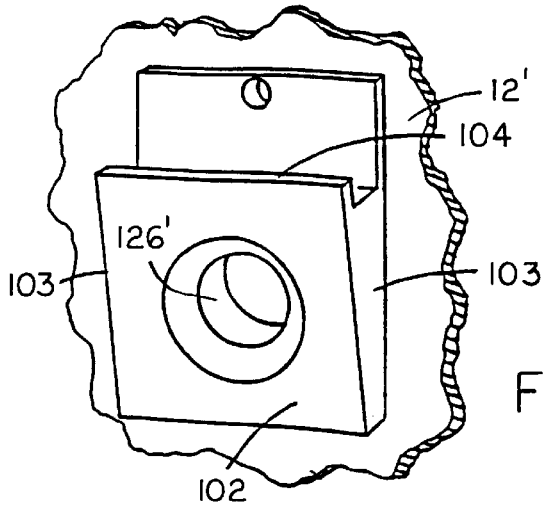
FIG. 15 is a perspective view of the wall of the vibratory screening machine mounting the base onto which the tightening nut assembly is mounted.
Figure 16:
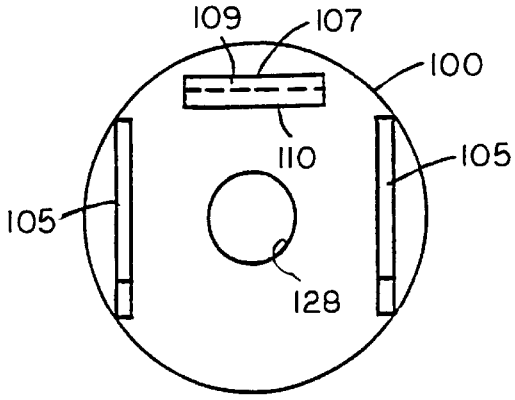
FIG. 16 is a plan view of the rear of the fixed member of the tightening nut assembly which mounts on the base of FIG. 15.
Figure 17:
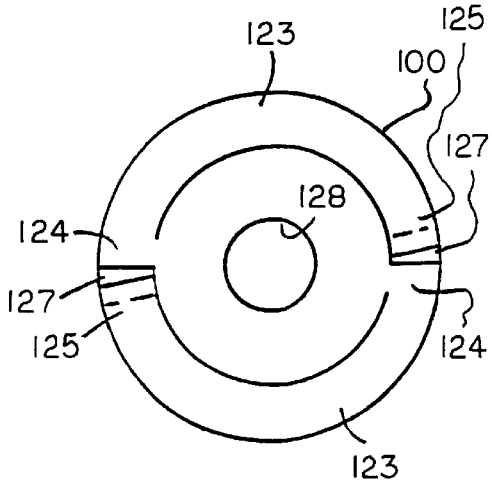
FIG. 17 is a plan view of the front of the fixed member of the tightening nut assembly.
Figure 18:
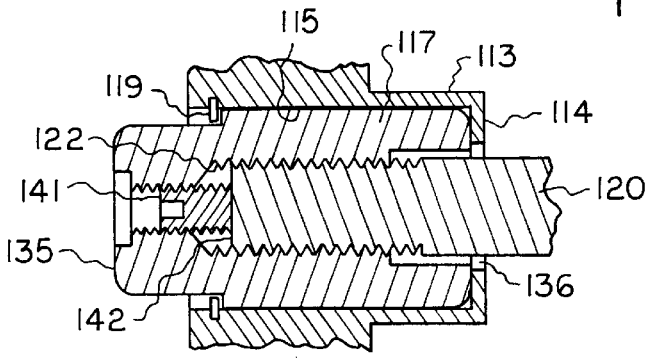
FIG. 18 is a fragmentary cross sectional view showing the connection between the movable member of the tightening nut assembly and the bolt which is attached to the movable tensioning member.

Each screen assembly is mounted in the following manner: Nut portion 111 of each tensioning member is rotated so as to cause cam followers 129 to return to the low portions 124 of cam surfaces 123, as shown in FIG. 14. This will permit spring 41 of each tensioner 45 to return to its unstressed condition (FIG. 6) to thereby push each elongated body 30 away from wall 12'. At this time edge 62 of each screen assembly 22 is placed over two adjacent tensioning members 25 and the opposite edge 63 is placed over two adjacent tensioning members 27 with fingers 33 and 53 within apertures 70 and 80. Thereafter, a wrench is applied to each nut 111 to thereby rotate movable tightening nut member 101 so that cam followers 129 will move from the low portion 124 of each cam 123 to the high portion 125 thereof. This will cause flexible resilient fingers 33 to move against aperture sides 81 and 82 to thereby pull the plate 61 until aperture sides 81 and 82 engage fingers 53 and thereafter continued movement of fingers 33 will tension screen plate 61 the proper amount. In this respect, the above-noted setting of fingers 33 approximately ⅜ inch from shelf 140 constitutes a dimension which causes the inner sides 137 of fingers 33 to be located a specified distance from the inner sides 137' of fingers 53, and this distance is slightly greater than the distance between opposed side edges 81 and opposed side edges 82 of plate sides 79 so that plate 61 is placed in the proper tension. The flexibility of the fingers permits all of them to engage the edges 81 and 82 during tensioning in the event these edges may not be in perfect alignment with each other.

As can be seen from FIGS. 3 and 14, support 143 positions bolt 120 at a proper angle so that it will not pivot downwardly due to the tensioning force applied at the upper ends of the fingers 33. Furthermore, the tensioner 25 is fabricated from rolled 17-4PH stainless steel and the fingers of tensioner 25 will deflect within their elastic limit to provide a biasing force on the edge 79 of plate 61. Since fingers 53 and 53' of stationary tensioning member 27 are mirror images of the fingers 33 and 45 of movable tensioning member 25, these fingers will yield the same amount. It is contemplated that tensioning members 25 and 27 may be fabricated out of cast 17-4PH stainless steel and they will provide action similar to that described above relative to plate steel tensioners 25 and 27. It will be appreciated that other types of steel can be used.

It is to be noted that the bends 150 at the lower edges of plate sides 62 and 63 act as beams which greatly rigidize side edges 79 of plate 61 against bending. The resistance to bending is also enhanced by the strips 92 and 93 of epoxy which extend the entire widths of plates 61.

As can be seen from FIGS. 3 and 14, the bolt of the tensioning structure extends through a hole in machine side 12' which is located below screen assembly 22 and the side edges of plate 61 rest on the sealing strips 146 which are mounted on shelves 130 and 139'. Therefore, material which is to be screened cannot bypass screen assembly 22 to mix with the material which passes through the screen. This obviates the shortcoming of the prior art wherein the bolt holes in the side of the machine were located above the screen assembly.

While the foregoing description has been directed to a specific undulating screen 22, it will be appreciated that the undulating screen need not be restricted to that, but it may vary therefrom so long as the screen has the critical features which permit it to be mounted in the above-described manner. In fact, the screen may be of the planar type provided that provision is made to suitably block the apertures through which the fingers extend and provided that the edges of the screen are strong enough to withstand the tensioning forces applied thereto. The blocking may be by essentially providing caps overlying the apertures with the caps being sufficiently hollow to receive the fingers.

While it has been described that there are a series of movable tensioners 25 on one side of the machine and a series of stationary tensioners 27 on the other side, it will be appreciated that a plurality of movable tensioners 25 can be mounted on both sides of the machine, (FIG. 20) but only those on one side need be actuated to mount and demount screens, provided that the tensioners on the other side remain in a tensioning attitude.

While preferred embodiments of the present invention have been disclosed, it will be appreciated that it is not limited thereto but may be otherwise embodied within the scope of the following claims.

What is claimed is:

1. A vibratory screen tensioning member comprising an elongated body, a base on said elongated body, and a plurality of spaced flexible resilient fingers on said base extending longitudinally of said body, each of said fingers having a first portion joined to said base, and a second portion joined to said first portion and which terminates at a free outer end, said second portion being narrower than said first portion.

2. A vibratory screen tensioning member as set forth in claim 1 wherein said first portions of adjacent fingers have sides which converge toward each other.

3. A vibratory screen tensioning member as set forth in claim 2 wherein a plurality of said fingers are symmetrical about their centerlines.

4. A vibratory screen tensioning member as set forth in claim 1 including a flat screen-engaging portion on each of said free outer ends of a plurality of said fingers.

5. A vibratory screen tensioning member comprising an elongated body, a base on said elongated body, and a plurality of spaced flexible resilient fingers on said base extending longitudinally of said body, said base being substantially U-shaped in cross section and including first and second sides with a U-bend therebetween.

6. A vibratory screen tensioning member as set forth in claim 5 wherein said fingers extend outwardly from said first side.

7. A vibratory screen tensioning member as set forth in claim 6 including an elongated stiffener bar connected to said second side.

8. A vibratory screen tensioning member as set forth in claim 7 wherein said elongated stiffener bar includes a central portion connected to a central portion of said second side and outer end portions connected to outer end portions of said second side.

9. A vibratory screen tensioning member as set forth in claim 6 including a bolt extending outwardly from said second side on the opposite side thereof from said first side.

10. A vibratory screen tensioning member as set forth in claim 9 wherein said bolt is centrally located on said second side.

11. A vibratory screen tensioning member as set forth in claim 10 including a spring connected to said second sides on the opposite side thereof from said first side.

12. A vibratory screen tensioning member as set forth in claim 9 including a stiffener on said second side between said first and second sides.

13. A vibratory screen tensioning member as set forth in claim 5 including an elongated leaf spring connected to said second side on the opposite side thereof from said first side.

14. A vibratory screen tensioning member as set forth in claim 5 including a block effectively connected to said second side at the substantially central portion thereof.

15. A vibratory screen tensioning member as set forth in claim 14 including a bolt connected to said block and extending outwardly in a direction away from said second side.

16. A vibratory screen tensioning member as set forth in claim 15 wherein each of said fingers has a first portion joined to said first side, and a second portion joined to said first portion and which terminates at a free outer end.

17. A vibratory screen tensioning member as set forth in claim 16 wherein said second portion is narrower than said first portion.

18. A vibratory screen tensioning member as set forth in claim 17 wherein said first portions of adjacent fingers have sides which converge toward each other.

19. A vibratory screen tensioning member as set forth in claim 18 wherein a plurality of said fingers are symmetrical about their centerlines.

20. A vibratory screen tensioning member as set forth in claim 5 wherein said U-bend is flexible and resilient.

21. A vibratory screen tensioning member as set forth in claim 20 including an elongated stiffener bar connected to said second side.

22. A vibratory screen tensioning member as set forth in claim 21 wherein said elongated stiffener bar includes a central portion connected to a central portion of said second side and outer end portions connected to outer end portions of said second side.

23. A vibratory screen tensioning member as set forth in claim 5 including a flat screen-engaging surface on each of a plurality of said fingers.

24. A vibratory screening machine comprising a frame, opposed first and second side walls on said frame, a fixed screen-engaging member on said first wall, a movable screen-engaging member on said second wall, said fixed screen-engaging member comprising a series of first spaced fingers proximate said first wall, and said movable screen-engaging member comprising a series of spaced flexible and resilient second fingers on an elongated U-shaped body mounted proximate said second wall.

25. A vibratory screening machine as set forth in claim 24 wherein said series of said first spaced fingers is also flexible and resilient.

26. A vibratory screening machine as set forth in claim 25 wherein said first fingers are located on another elongated body.

27. A vibratory screening machine as set forth in claim 26 wherein said first and second fingers are upwardly inclined relative to said first and second walls, respectively.

28. A vibratory screening machine as set forth in claim 24 including a screen, a plate on said screen, first and second side edges on said screen, first and second series of spaced apertures on said first and second side edges, respectively, and said first and second fingers being located in said first and second spaced apertures, respectively.

29. A vibratory screening machine as set forth in claim 28 including first and second sides in said first and second apertures, respectively, and said first and second fingers in engagement with said first and second sides, respectively.

30. A vibratory screening machine as set forth in claim 29 wherein said series of said first spaced fingers is also flexible and resilient.

31. A vibratory screening machine as set forth in claim 30 wherein said first fingers are located on another elongated body.

32. A vibratory screening machine as set forth in claim 31 wherein said first and second fingers are upwardly inclined relative to said first and second walls, respectively.

33. A vibratory screening machine as set forth in claim 29 wherein said first fingers are spaced a first distance from said second fingers when said screen is in an untensioned condition, and wherein said second fingers are movable to a second greater distance from said first fingers to thereby tension said plate.

34. A vibratory screening machine as set forth in claim 24 including a support mounted on said second wall in engagement with said movable screen engaging member.

35. A vibratory screening machine as set forth in claim 34 wherein said support is in engagement with the underside of said elongated U-shaped body.

36. A vibratory screening machine as set forth in claim 29 wherein said first and second fingers are spaced a predetermined distance apart when said screen is in an untensioned condition, and wherein said first fingers are located on a first elongated body, and wherein said second elongated U-shaped body is movable to a second predetermined distance from said first elongated body to thereby tension said plate.

37. A vibratory screening machine comprising a frame, opposed first and second side walls on said frame, a fixed screen-engaging member on said first wall, a movable screen-engaging member on said second wall, said fixed screen-engaging member comprising a series of first spaced fingers proximate said first wall, said movable screen-engaging member comprising a series of spaced second fingers proximate said second wall, with at least one of said first and second series of spaced fingers being flexible and resilient, a screen, a plate on said screen, first and second side edges on said screen, first and second series of spaced apertures on said first and second side edges, respectively, said first and second fingers being located in said first and second spaced apertures, respectively, first and second sides in said first and second apertures, respectively, said first and second fingers engageable with said first and second sides, respectively, said first and second fingers being spaced a predetermined distance apart when said screen is in an untensioned condition, said first and second fingers being located on first and second elongated bodies, respectively, said second elongated body being movable to a second predetermined distance from said first elongated body to thereby tension said plate, a bolt extending substantially perpendicularly to said second elongated body, a cam body mounted on said second side wall and mounting said bolt, and a cam follower secured to said bolt and positioned adjacent to said cam body.

38. A vibratory screen comprising a plate, first and second side edges on said plate, first and second series of spaced apertures proximate said first and second side edges, respectively, first and second flanges on said plate located outwardly of said first and second series of apertures, respectively, an undulating screen on said plate, and first and second side edges on said screen secured to said first and second flanges, respectively, said first and second side edges of said screen including first and second side edge portions spaced from said first and second flanges, respectively, and first and second bonding agents between said first and second side edge portions and said first and second flanges, respectively.

39. A vibratory screen as set forth in claim 38 wherein said first and second bonding agents are epoxy.

40. A vibratory screen as set forth in claim 38 including third and fourth side edge portions on said screen located on the opposite sides of said first and second side edge portions from said first and second flanges, respectively, said third and fourth side edge portions being immediate continuations of said first and second side edge portions, respectively, and extending downwardly away from said first and second side edge portions, respectively.

41. A vibratory screen comprising a plate, first and second side edges on said plate, first and second series of spaced apertures proximate said first and second side edges, respectively, first and second flanges on said plate located outwardly of said first and second series of apertures, respectively, an undulating screen on said plate, ridges and troughs on said undulating screen, and first and second outermost portions on said screen adjacent to said first and second flanges, overlying said first and second series of apertures and being spaced therefrom.

* * * * *

UNITED STATES PATENT AND TRADEMARK OFFICE

CERTIFICATE OF CORRECTION

PATENT NO. : 6,669,027 B1
DATED : December 30, 2003
INVENTOR(S) : James A. Mooney et al.

Figure 13:
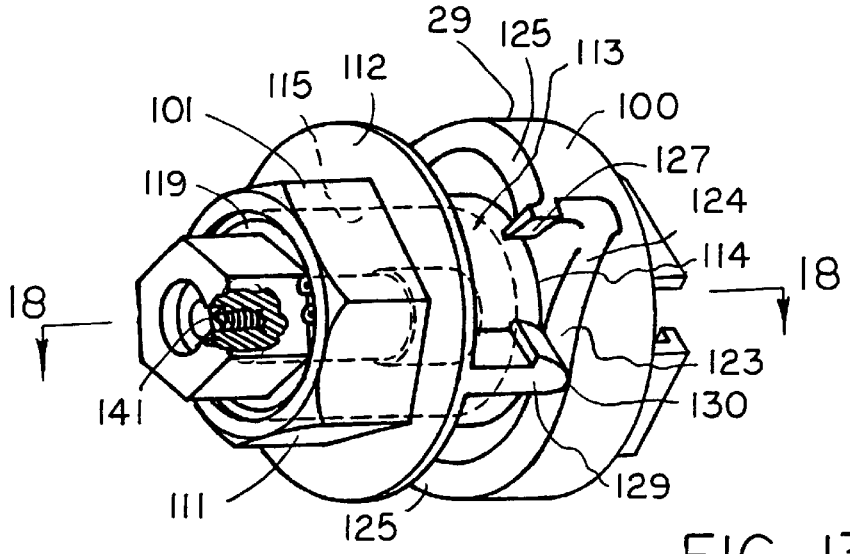
FIG. 13 is a perspective view of the tightening nut assembly.

It is certified that error appears in the above-identified patent and that said Letters Patent is hereby corrected as shown below:

Column 3,
Line 3, after "machine" insert -- and taken substantially in the direction of arrows 10-10 of FIG. 3 --.
Line 22, after "view" insert -- taken substantially along line 18-18 of FIG. 13 and --.
Line 29, after "machine" insert -- and having movable tensioning members mounted on only one side of the machine --.
Line 54, change "assembly 16" to -- assembly 16' --.

Column 9,
Line 25, change "sides" to -- side --.

Column 10,
Line 19, change "screen" to -- plate --.

Column 12,
Line 22, after "flanges" insert -- respectively, --.

Signed and Sealed this

Fifteenth Day of June, 2004

JON W. DUDAS
*Acting Director of the United States Patent and Trademark Office*